US010808528B2

(12) United States Patent
Rowe et al.

(10) Patent No.: US 10,808,528 B2
(45) Date of Patent: Oct. 20, 2020

(54) ON-SITE MASS SPECTROMETRY FOR LIQUID AND EXTRACTED GAS ANALYSIS OF DRILLING FLUIDS

(71) Applicant: Halliburton Energy Services, Inc., Houston, TX (US)

(72) Inventors: Mathew Dennis Rowe, Lafayette, LA (US); David Kirkpatrick Muirhead, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 349 days.

(21) Appl. No.: 14/906,511

(22) PCT Filed: Mar. 6, 2014

(86) PCT No.: PCT/US2014/021114
§ 371 (c)(1),
(2) Date: Jan. 20, 2016

(87) PCT Pub. No.: WO2015/026394
PCT Pub. Date: Feb. 26, 2015

(65) Prior Publication Data

US 2016/0160641 A1 Jun. 9, 2016

Related U.S. Application Data

(63) Continuation-in-part of application No. PCT/US2013/056297, filed on Aug. 22, 2013.

(51) Int. Cl.
*H01J 49/00* (2006.01)
*E21B 49/00* (2006.01)
(Continued)

(52) U.S. Cl.
CPC ..... *E21B 49/005* (2013.01); *E21B 21/01* (2013.01); *E21B 21/067* (2013.01); *E21B 49/00* (2013.01);
(Continued)

(58) Field of Classification Search
CPC ..... E21B 49/00; E21B 49/005; E21B 49/08; E21B 49/081; E21B 49/083;
(Continued)

(56) References Cited

U.S. PATENT DOCUMENTS 4,287,957 A * 9/1981 Evans ..... E21B 10/18 175/17
4,635,735 A * 1/1987 Crownover ..... E21B 21/067 175/42
(Continued)

FOREIGN PATENT DOCUMENTS

FR 2774768 A1 8/1999
GB 2491443 A 12/2012
(Continued)

OTHER PUBLICATIONS

International Preliminary Report on Patentability issued in related PCT Application No. PCT/US2013/056297 dated Mar. 3, 2016, 11 pages.
(Continued)

*Primary Examiner* — Jason L McCormack
(74) *Attorney, Agent, or Firm* — Scott Richardson; Baker Botts L.L.P.

(57) ABSTRACT

An example method for analyzing drilling fluid used in a drilling operation within a subterranean formation may include receiving a drilling fluid sample from a flow of drilling fluid at a surface of the subterranean formation. A chemical composition of the drilling fluid sample may be determined using a mass spectrometer. A formation charac-
(Continued)

teristic of the subterranean formation may be determined using the determined chemical composition. Determining the chemical composition of the drilling fluid sample may include determining the chemical composition of at least one of extracted gas from the drilling fluid sample and a liquid portion of the drilling fluid sample.

13 Claims, 8 Drawing Sheets

(51) Int. Cl.

| | |
|---|---|
| ***E21B 21/01*** | (2006.01) |
| ***E21B 21/06*** | (2006.01) |
| ***E21B 49/08*** | (2006.01) |
| ***H01J 49/26*** | (2006.01) |
| *H01J 49/40* | (2006.01) |

(52) U.S. Cl.
CPC ..... *E21B 49/086* (2013.01); *H01J 49/0027* (2013.01); *H01J 49/26* (2013.01); *H01J 49/40* (2013.01)

(58) Field of Classification Search
CPC ..... E21B 49/084; E21B 49/086; H01J 49/00; H01J 49/02; H01J 49/04; H01J 49/0431
USPC ..... 73/152.01, 152.03, 152.04, 152.08, 73/152.43, 152.45; 250/281, 282, 287
See application file for complete search history.

(56) References Cited

U.S. PATENT DOCUMENTS

| | | | | |
|---|---|---|---|---|
| 4,833,915 | A | 5/1989 | Radd et al. | |
| 6,661,000 | B2 | 12/2003 | Smith et al. | |
| 6,670,605 | B1 | 12/2003 | Storm, Jr. et al. | |
| 7,219,541 | B2 | 5/2007 | DiFoggio | |
| 7,395,691 | B2 | 7/2008 | Sterner et al. | |
| 7,944,211 | B2 | 5/2011 | Smits | |
| 8,013,295 | B2 | 9/2011 | Zhdaneev et al. | |
| 8,056,408 | B2 | 11/2011 | Pop et al. | |
| 8,145,429 | B2 | 3/2012 | DiFoggio et al. | |
| 2003/0173072 | A1* | 9/2003 | Vinegar | E21B 17/028 166/66.5 |
| 2004/0026125 | A1 | 2/2004 | Meister et al. | |
| 2007/0137293 | A1* | 6/2007 | Pop | E21B 49/081 3/152.23 |
| 2007/0169540 | A1 | 7/2007 | Sterner et al. | |
| 2010/0089120 | A1 | 4/2010 | Hanson | |
| 2010/0181471 | A1 | 7/2010 | Pop et al. | |
| 2011/0084202 | A1* | 4/2011 | Finlay | G01N 33/2823 250/254 |
| 2011/0088895 | A1* | 4/2011 | Pop | E21B 7/04 166/254.2 |
| 2011/0266056 | A1* | 11/2011 | Pop | E21B 49/08 175/50 |
| 2012/0000279 | A1* | 1/2012 | Daniel | E21B 49/10 73/152.28 |
| 2012/0267525 | A1 | 10/2012 | Sasai et al. | |
| 2012/0285680 | A1* | 11/2012 | Kumar | E21B 43/38 166/264 |
| 2013/0087698 | A1 | 4/2013 | Pomerantz et al. | |
| 2013/0192360 | A1 | 8/2013 | Jamison et al. | |
| 2013/0311096 | A1* | 11/2013 | Greer | G01N 30/88 702/9 |

FOREIGN PATENT DOCUMENTS

| | | | |
|---|---|---|---|
| NO | 302978 | B1 | 5/1998 |
| WO | 2012-112154 | A1 | 8/2012 |

OTHER PUBLICATIONS

International Search Report and Written Opinion issued in related PCT Application No. PCT/US2013/056297 dated May 14, 2014, 16 pages.
"The DQ1000 TM Quadrupole Mass Sped" from http://fittulsa.com/dq1000.php, 2 pages.
S. Ramaswami et al., "Integration of Advanced Mud Gas Logs, Petrophysical Logs and Formation Testing for Fluid Typing—A Middle East Case Study", Paper No. SPWLA-2012-052 (2012), 16 pages.
Warren et al. "Application of DQMS Analysis in an Oil Producing Fractured Carbonate System", AAPG Search and Discovery Article No. 40938 (2012), 5 pages.
Hall et al., "Analysis of Borehole Gas with Direct Quadrupole Mass Spectrometry", AAPG Hedberg Conference, Jun. 3-11, 2010, 4 pages.
International Search Report and Written Opinion issued in related PCT Application No. PCT/US2014/021114 dated Jul. 18, 2014, 14 pages.

* cited by examiner

ON-SITE MASS SPECTROMETRY FOR LIQUID AND EXTRACTED GAS ANALYSIS OF DRILLING FLUIDS

CROSS-REFERENCE TO RELATED APPLICATIONS

The present application claims priority to International Application Number PCT/US2014/21114 filed on 6 Mar. 2014 entitled "ON-SITE MASS SPECTROMETRY FOR LIQUID AND EXTRACTED GAS ANALYSIS OF DRILLING FLUIDS", which is a continuation-in-part of, and claims priority to International Application Number PCT/US2013/56297, filed on 22 Aug. 2013 entitled "DRILLING FLUID ANALYSIS USING TIME-OF-FLIGHT MASS SPECTROMETRY," both of which are incorporated by reference herein in their entirety for all purposes.

BACKGROUND

During the drilling of subterranean wells, a fluid is typically circulated through a fluid circulation system comprising a drilling rig and fluid treatment/storage equipment located substantially at or near the surface of the well. The fluid is pumped by a fluid pump through the interior passage of a drill string, through a drill bit and back to the surface through the annulus between the well bore and the drill string. As the well is drilled, gasses and fluids from the formation may be released and captured in the fluid as it is circulated. In some instances, the gasses may be wholly or partially extracted from the fluid for analysis, and the fluids may otherwise be analyzed. The gas and fluid analysis may be used to determine characteristics about the formation. The sensitivity and speed of the gas and fluid analysis may affect the accuracy and reliability of the analysis data and, therefore, the accuracy of the formation characteristics determined using the analysis data.

FIGURES

Some specific exemplary embodiments of the disclosure may be understood by referring, in part, to the following description and the accompanying drawings.

Figure 3:
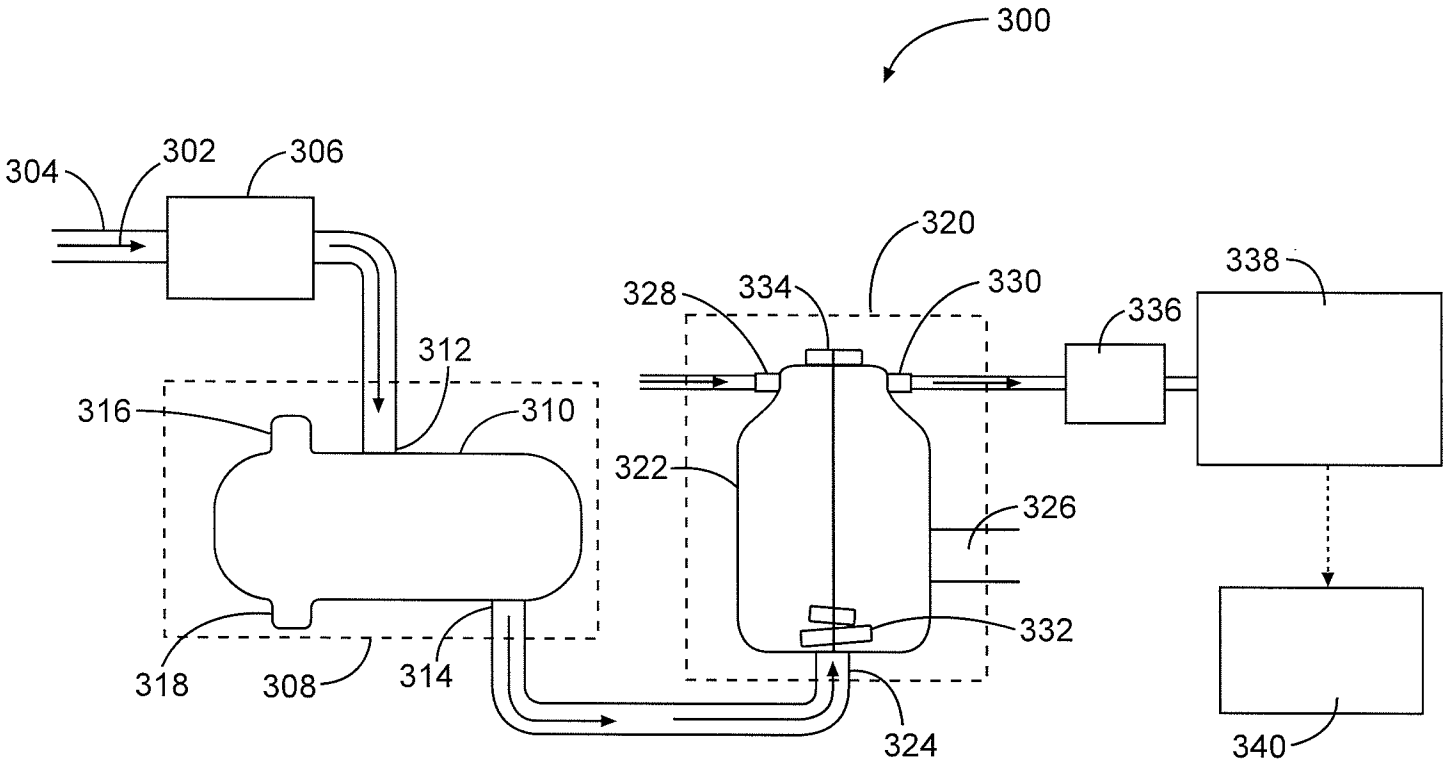
Figure 4:
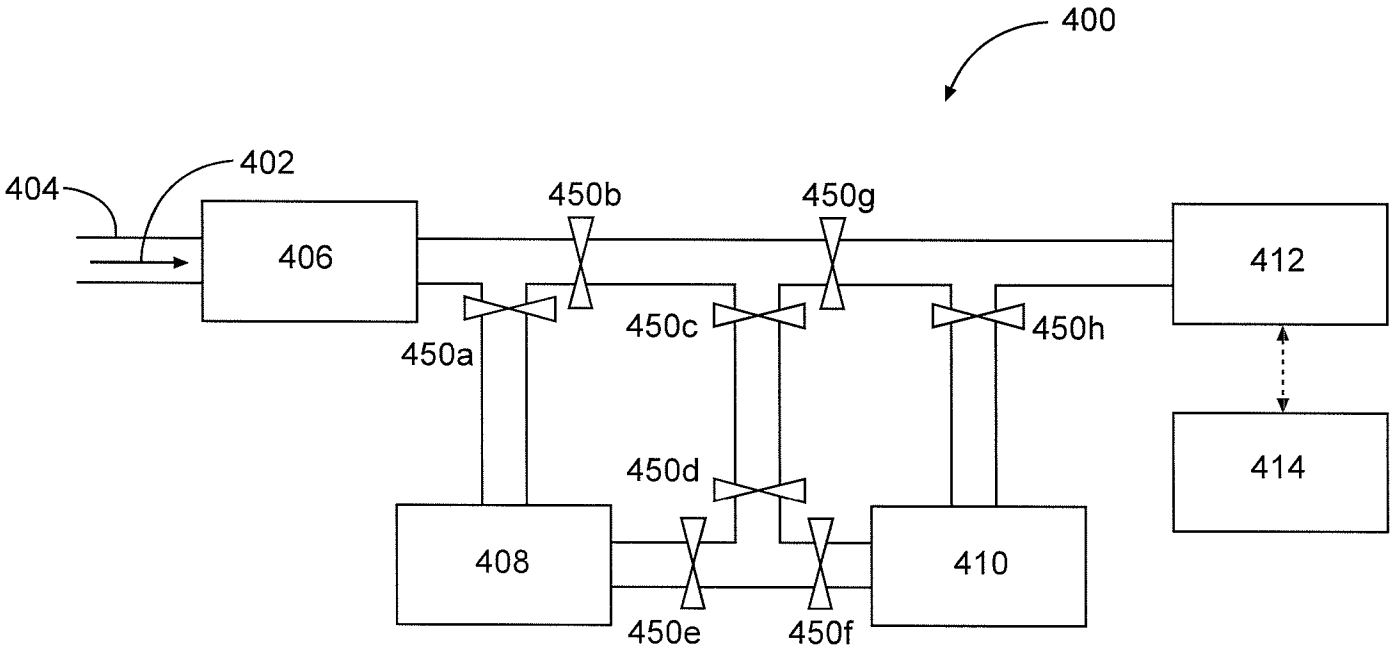
Figure 5:
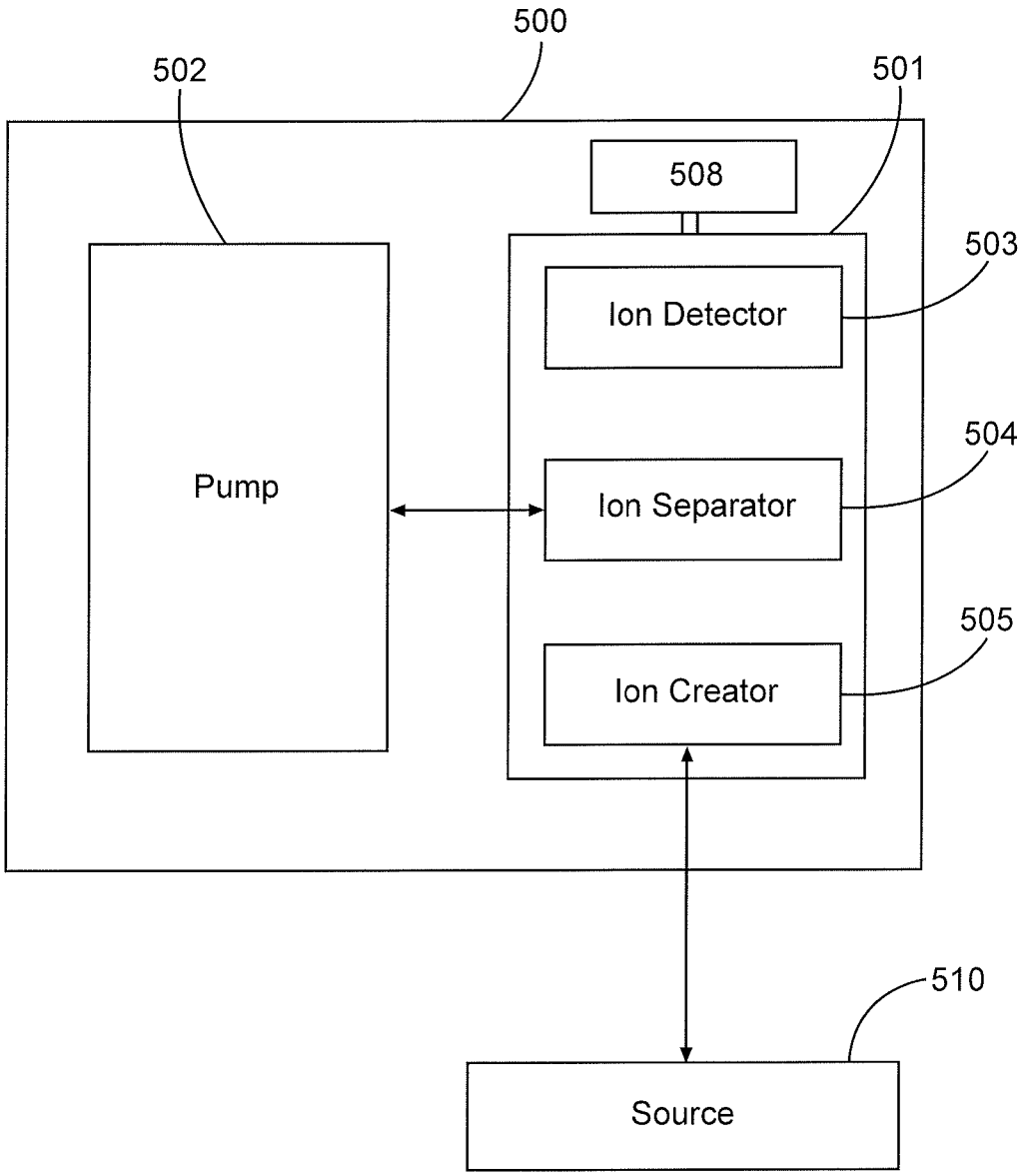

FIG. 3 is a block diagram of an example drilling fluid analyzer that extracts and analyzes gasses from a drilling fluid sample, according to aspects of the present disclosure FIG. 4 is a diagram of an example drilling fluid analyzer that prepares and analyzes liquids from a drilling fluid sample, according to aspects of the present disclosure FIG. 5 is a block diagram of an example mass spectrometer, according to aspects of the present disclosure.

Figure 6:
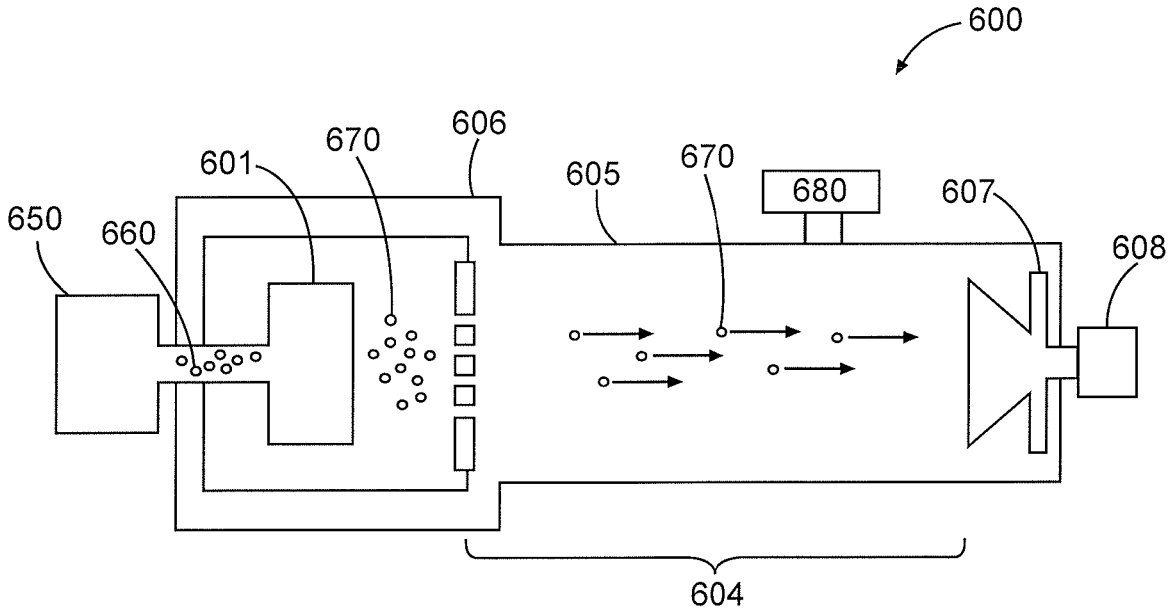

FIG. 6 is a diagram of an example time-of-flight mass spectrometer, according to aspects of the present disclosure.

Figure 7:
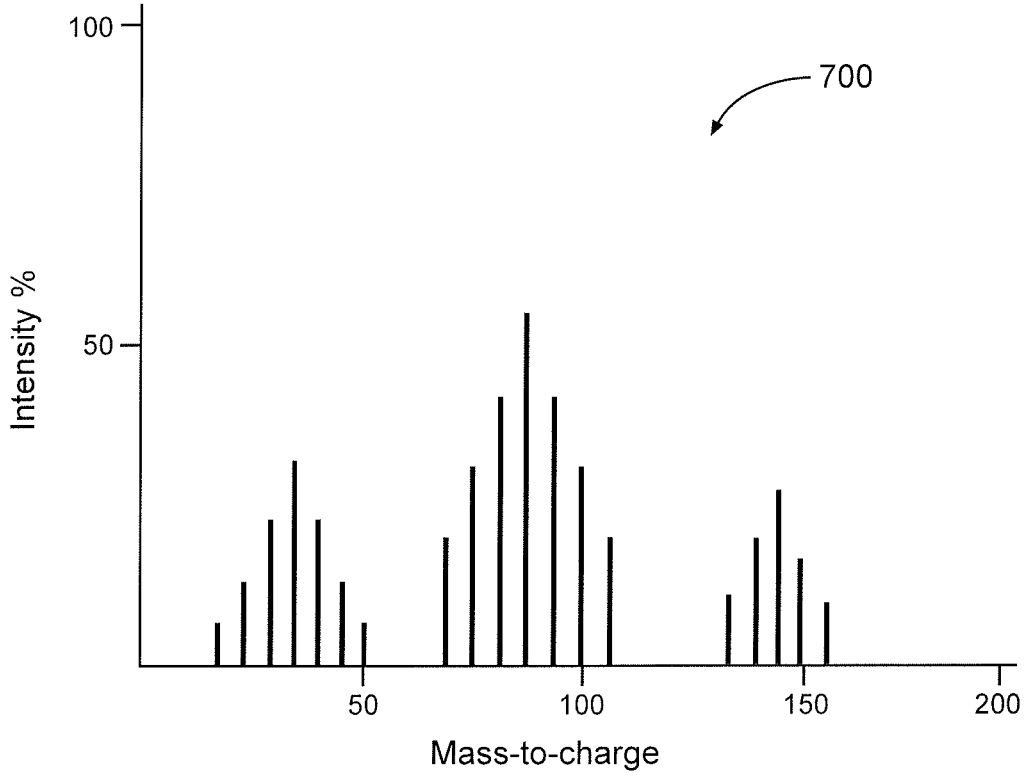

FIG. 7 is a chart of example mass spectra, according to aspects of the present disclosure.

Figure 8:
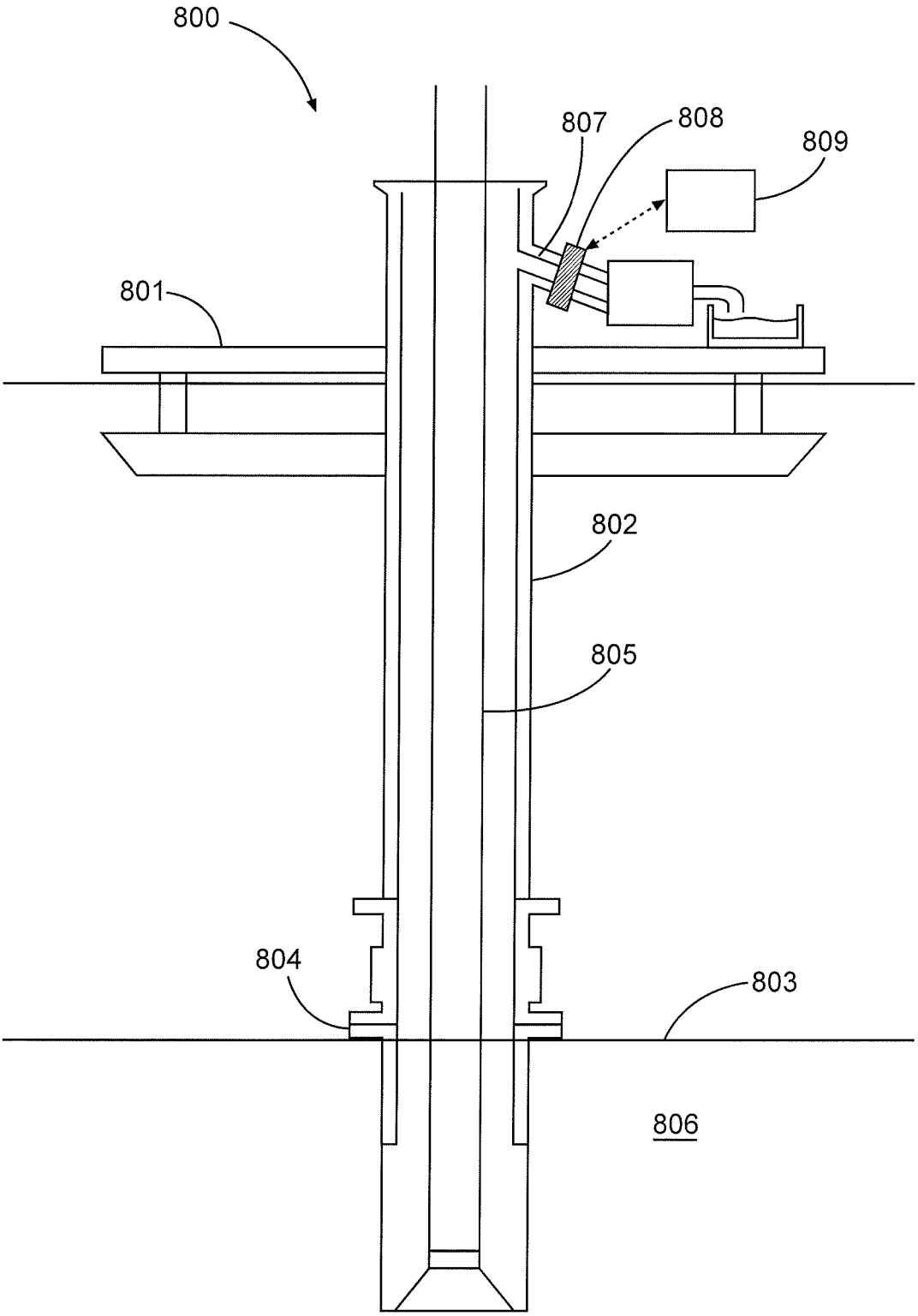

FIG. 8 is a diagram of an example offshore drilling system, according to aspects of the present disclosure.

Figure 9:
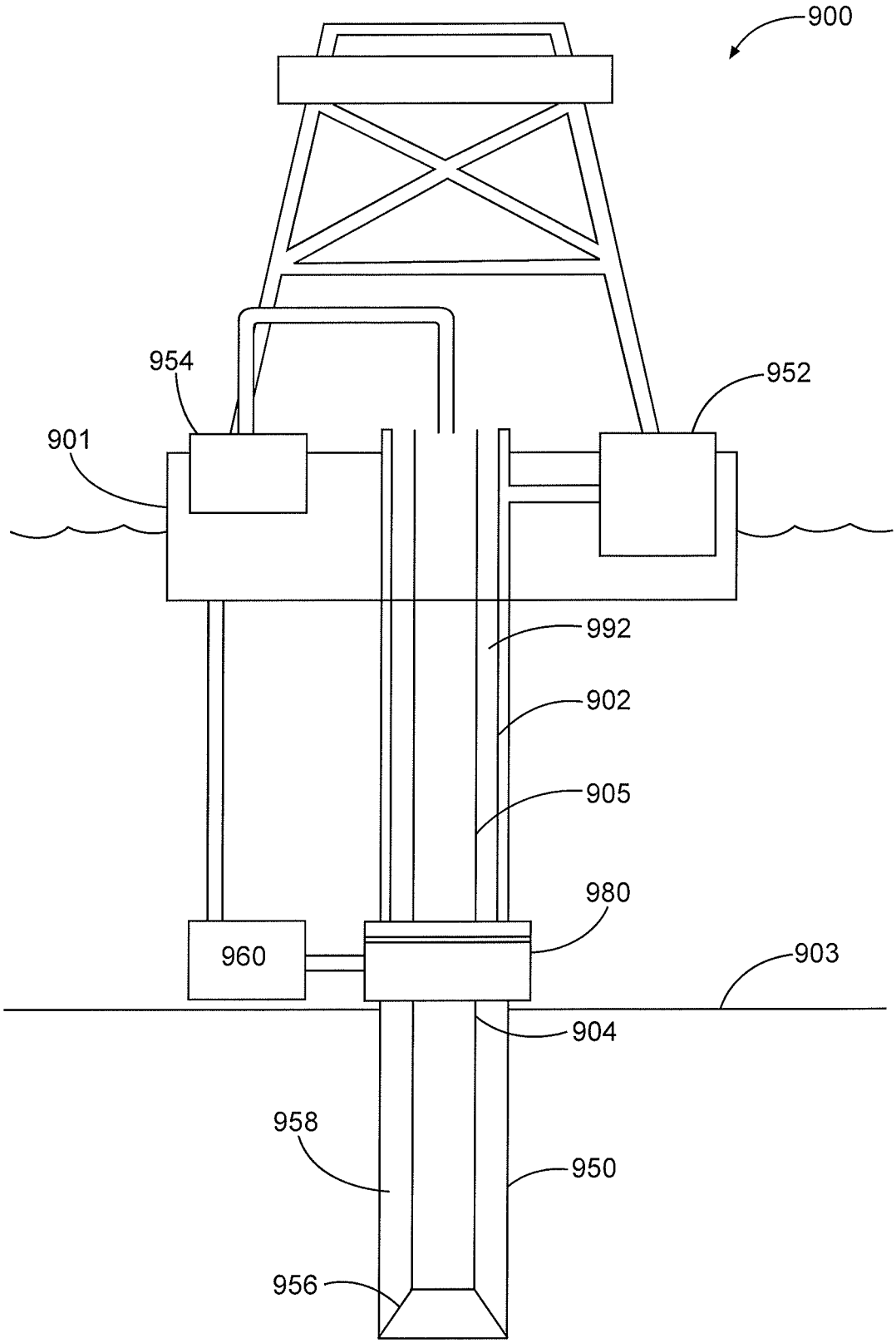

FIG. 9 is a diagram of an example offshore drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to on-site mass spectrometry for liquid and extracted gas analysis of drilling fluids.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to drilling operations that include, but are not limited to, target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, stimulation wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing downtime. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Thus, if a first device communicatively couples to a second device, that connection may be through a direct connection, or through an indirect communication connection via other devices and connections. The indefinite articles "a" or "an," as used herein, are defined herein to mean one or more than one of the elements that it introduces. The terms "gas" or "fluid," as used herein, are not limiting and are used interchangeably to describe a gas, a liquid, a solid, or some combination of a gas, a liquid, and/or a solid.

Figure 1:
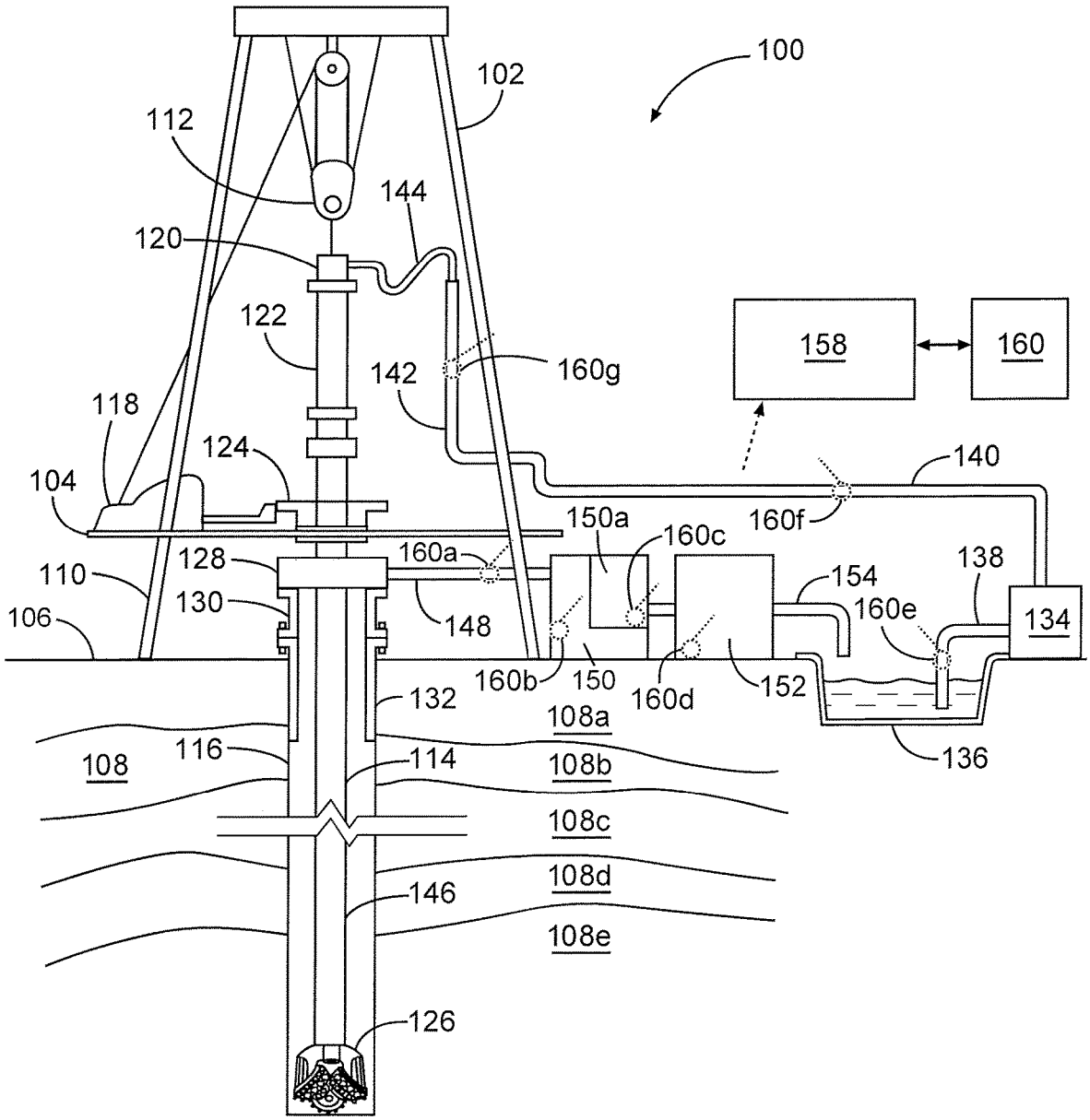
FIG. 1 is a diagram of an example drilling system, according to aspects of the present disclosure.

FIG. 1 is a diagram illustrating an example drilling system 100, according to aspects of the present disclosure. In the embodiment shown, the system 100 comprises a derrick 102 mounted on a floor 104 that is in contact with the surface 106 of a formation 108 through supports 110. The formation 108 may be comprised of a plurality of rock strata 108*a-e*, each of which may be made of different rock types with different characteristics. At least some of the strata may be porous and contain trapped liquids and gasses 108*a-e*. Although the system 100 comprises an "on-shore" drilling system in which floor 104 is at or near the surface, similar "off-shore" drilling systems are also possible and may be characterized by the floor 104 being separated by the surface 106 by a volume of water.

The derrick 102 may comprise a traveling block 112 for raising or lowering a drill string 114 disposed within a borehole 116 in the formation 108. A motor 118 may control the position of the traveling block 112 and, therefore, the drill string 114. A swivel 120 may be connected between the traveling block 112 and a kelly 122, which supports the drill string 114 as it is lowered through a rotary table 124. A drill bit 126 may be coupled to the drill string 114 and driven by a downhole motor (not shown) and/or rotation of the drill string 114 by the rotary table 124. As bit 126 rotates, it creates the borehole 116, which passes through one or more rock strata or layers of the formation 108.

The drill string 114 may extend downwardly through a bell nipple 128, blow-out preventer (BOP) 130, and wellhead 132 into the borehole 116. The wellhead 132 may include a portion that extends into the borehole 116. In certain embodiments, the wellhead 132 may be secured within the borehole 116 using cement. The BOP 130 may be coupled to the wellhead 132 and the bell nipple 128, and may work with the bell nipple 128 to prevent excess pressures from the formation 108 and borehole 116 from being released at the surface 106. For example, the BOP 130 may comprise a ram-type BOP that closes the annulus between the drill string 114 and the borehole 116 in case of a blowout.

During drilling operations, drilling fluid, such as drilling mud, may be pumped into and received from the borehole 116. In certain embodiments, this drilling fluid may be pumped and received by a fluid circulation system 190 at the surface 106 of the formation 108. As used herein, a fluid circulation system 190 may be positioned at the surface if it is arranged at or above the surface level. In the embodiment shown, the fluid circulation system 190 may comprise the fluid circulation, processing, and control elements between the bell nipple 128 and the swivel 120, as will be described below. Specifically, the fluid circulation system 190 may include a mud pump 134 that may pump drilling fluid from a reservoir 136 through a suction line 138 into the drill string 114 at the swivel 120 through one or more fluid conduits, including pipe 140, stand-pipe 142, and hose 144. Once introduced at the swivel 120, the drilling mud then may flow downhole through the drill string 114, exiting at the drill bit 126 and returning up through an annulus 146 between the drill string 114 and the borehole 116 in an open-hole embodiments, or between the drill string 114 and a casing (not shown) in a cased borehole embodiment. While in the borehole 116, the drilling mud may capture fluids and gasses from the formation 108 as well as particulates or cuttings that are generated by the drill bit 126 engaging with the formation 108.

In certain embodiments, the fluid circulation system 190 further may comprise a return line 148 coupled to the bell nipple 128. Drilling fluid may flow through the return line 148 as it exits the annulus 146 via the bell nipple 128. The fluid circulation system 190 further may comprise one or more fluid treatment mechanisms coupled to the return line 148 that may separate the particulates from the returning drilling mud before returning the drilling mud to the reservoir 136, where it can be recirculated through the drilling system 100. In the embodiment shown, the fluid treatment mechanisms may comprise a mud tank 150 (which may also be referred to as a header box or possum belly) and a shale shaker 152. The mud tank 150 may receive the flow of drilling mud from the annulus 146 and slow it so that the drilling mud does not shoot past the shale shaker 152. The mud tank 150 may also allow for cuttings to settle and gasses to be released. In certain embodiments, the mud tank 150 may comprise a gumbo trap or box 150*a*, which captures heavy clay particulates before the drilling mud moves to the shale shaker 152, which may separate fine particulates from the drilling mud using screens. The drilling mud may flow from the fluid treatment mechanisms into the reservoir 136 through fluid conduit 154.

According to aspects of the present disclosure, the system 100 may further include a drilling fluid analyzer 158 that receives drilling fluid samples from the drilling system 100 and analyzes the liquid portions of the drilling fluid or extracts and analyzes gases within the drilling fluid, which can in turn be used to characterize the formation 108. The drilling fluid analyzer 158 may comprise a stand-alone machine or mechanism or may comprise integrated functionality of a larger analysis/extraction mechanism. The drilling fluid analyzer 158 may be in fluid communication with and take drilling fluid samples from the fluid circulation system 190, including, but not limited to, access point 160*a* on the return line 148, access point 160*b* on the mud tank 150, access point 160*c* on the gumbo box 150*a*, access point 160*d* on the shale shaker 152, access point 160*e* on the suction line 138, access point 160*f* on the pipe 140, and access point 160*g* on the stand pipe 142. Fluid communication may be provided via at least one probe in fluid communication with the flow of drilling fluid at any one of the access points. In other embodiments, the drilling fluid analyzer 158 may coupled to one or more of the fluid channels such that the flow of drilling fluid passes through the drilling fluid analyzer 158.

At least some of the strata 108*a-e* may contain trapped fluids and gasses that are held under pressure. As the borehole 116 penetrates new strata, some of these fluids may be released into the borehole 116. The released fluids may become suspended or dissolved in the drilling fluid as it exits the drill bit 126 and travels through the borehole annulus 146. Each released fluid and gas may be characterized by its chemical composition, and certain formation strata may be identified by the fluids and gasses it contains. As will be described below, the drilling fluid analyzer 158 may take periodic or continuous samples of the drilling fluid, for example, by pumping, gravity drain or diversion of flow, or other means. The drilling fluid analyzer 158 may generate corresponding measurements of the fluid sample or extracted gas from the fluid sample that may be used to determine the chemical composition of the drilling fluid. This chemical composition may be used to determine the types of fluids and gasses that are suspended within the drilling fluid, which can then be used to determine a formation characteristic of the formation 105.

The drilling fluid analyzer 158 may include or be communicably coupled to an information handling system 160. In the embodiment shown, the information handling system 160 comprises a computing system located at the surface that may receive measurements from the drilling fluid analyzer 158 and process the measurements to determine at least one formation characteristic based on the drilling fluid sample. In certain embodiments, the information handling system 160 may further control the operation of the drilling fluid analyzer 158, including how often the drilling fluid analyzer 158 take measurements and fluid samples. In certain embodiments, the information handling system 160 may be dedicated to the drilling fluid analyzer 158. In other embodiments, the information handling system 160 may receive measurements from a variety of devices in the drilling system 100 and/or control the operation of other devices.

The output of the drilling fluid analyzer 158 may comprise electrical signals or data that corresponds to measurements taken by the drilling fluid analyzer 158 of liquids and/or extracted gases from the drilling fluid samples. In certain embodiments, the information handling system 160 may receive the output from the drilling fluid analyzer 158 and determine characteristics of the liquid and/or extracted gas is the drilling fluid sample, such as corresponding chemical compositions. The chemical compositions of the drilling fluid may comprise the types of chemicals found in the drilling fluid sample and extracted gasses from drilling fluid sample and their relative concentrations. The information handling system 160 may determine the chemical composition, for example, by receiving an output from drilling fluid analyzer 158, and comparing the output to a first data set corresponding to known chemical compositions. In certain embodiments, the information handling system 160 may fully characterize the chemical composition of the drilling fluid sample based on the output from the drilling fluid analyzer 158. The information handling system 160 may further determine the types of fluids and gasses suspended within the drill fluid based on the determined chemical composition. Additionally, in certain embodiments, the information handling system 160 may determine a characteristic of the formation 108 using the determined types and concentrations of fluids and gasses suspended within the drill fluid by comparing the determined types and concentrations of fluids and gasses suspended within the drill fluid to a second data set the includes types and concentrations of fluids and gasses suspended within the drilling fluid of known subterranean formations.

For example, the information handling system 160 may determine a formation characteristic using the determined chemical composition. An example determined chemical composition for the liquid portion of a drilling fluid may be 15% chemical/compound A, 20% chemical/compound B, 60% chemical/compound C, and 5% other chemicals/compounds. Example downhole characteristics include, but are not limited to, the type of rock in the formation 108, the presences of hydrocarbons in the formation 108, the production potential for a strata 108*a-e* of the formation 108, and the movement of fluid within a strata 108*a-e*. In certain embodiments, the information handling system 160 may determine the formation characteristic using the determined chemical composition characteristics by comparing the determined chemical composition to a second data set the includes chemical compositions of known subterranean formations. For example, the determined chemical composition may correspond to a drilling fluid with suspended fluid from a shale layer in the formation 108.

Figure 2:
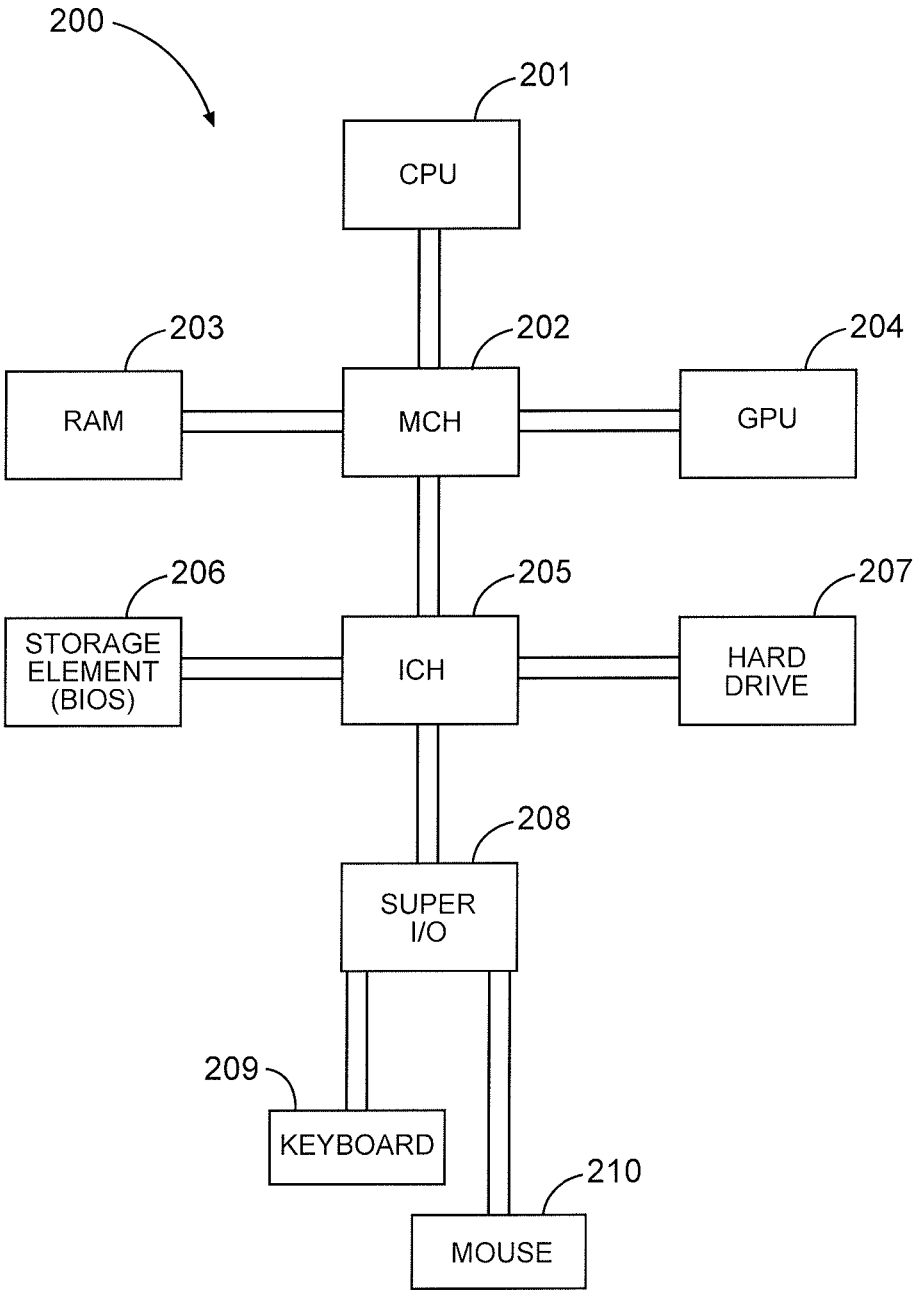
FIG. 2 is a block diagram of an example information handling system, according to aspects of the present disclosure.

FIG. 2 is a block diagram showing an example information handling system 200, according to aspects of the present disclosure. A processor or CPU 201 of the information handling system 200 is communicatively coupled to a memory controller hub or north bridge 202. Memory controller hub 202 may include a memory controller for directing information to or from various system memory components within the information handling system, such as RAM 203, storage element 206, and hard drive 207. The memory controller hub 202 may be coupled to RAM 203 and a graphics processing unit 204. Memory controller hub 202 may also be coupled to an I/O controller hub or south bridge 205. I/O hub 205 is coupled to storage elements of the computer system, including a storage element 206, which may comprise a flash ROM that includes a basic input/output system (BIOS) of the computer system. I/O hub 205 is also coupled to the hard drive 207 of the computer system. I/O hub 205 may also be coupled to a Super I/O chip 208, which is itself coupled to several of the I/O ports of the computer system, including keyboard 209 and mouse 210. In certain embodiments, the Super I/O chip may also be connected to and receive input from a liquid and/or extracted gas analyzer, similar to drilling fluid analyzer 158 from FIG. 1. Additionally, at least one memory component of the information handling system 200, such as the hard drive 207, may contain a set of instructions that, when executed by the processor 201, cause the processor 201 to perform certain actions with respect to outputs received from a drilling fluid analyzer, such as determine a chemical composition of a drilling fluid sample or a characteristic of a corresponding formation.

FIG. 3 is a diagram of an example drilling fluid analyzer 300 that extracts and analyzes gasses from a drilling fluid sample, according to aspects of the present disclosure. The analyzer 300 may be included with a drilling system at the surface of a formation, and may be in selective fluid communication with a flow of drilling fluid through the drilling system, such as at access points similar to those described above. In the embodiment shown, the analyzer 300 may receive a drilling fluid sample 302 through a fluid conduit or pipe 304 that is in selective fluid communication with the flow of drilling fluid. As described above, drilling fluid samples may be taken periodically or continuously from the flow of drilling fluid through a drilling system, and the drilling fluid sample 302 may comprise one of those continuous or periodic samples. The analyzer 300 may comprise a pump 306 that pushes the drilling fluid sample toward a sample-temperature control unit 308 of the analyzer 300. The sample-temperature control unit 308 may be configured to alter or maintain the temperature of the drilling fluid sample 302 at a set temperature, which may be hotter, cooler, or the same as the temperature of the sample 302 as it enters the analyzer 300. In the embodiment shown, the sample-temperature control unit 308 comprises a shell and tube heat exchanger with two sets of fluid inlets and outlets: first inlet and outlet 312 and 314, respectively, and second inlet and outlet 316 and 318, respectively. Each set of fluid inlets and outlets may correspond to a different, segregated fluid pathway through the shell 310. For example, the second inlet and outlet 316 and 318 may correspond to a fluid pathway comprising a system of sealed tubes (not shown) located within the shell 310, and the first inlet and outlet 312 and 314 may correspond to a fluid pathway in which fluid flows around the system of sealed tubes. The system of sealed tubes may comprise u-tubes, single-pass straight tubes, double-pass straight tubes, or other configurations that would be appreciated by one of ordinary skill in the art in view of this disclosure.

In certain embodiments, the sample 302 may enter the shell 310 through fluid inlet 312 and exit through fluid outlet 314. A second fluid or gas may enter the shell 310 through fluid inlet 316 and exit through outlet 318. Either the second fluid or the sample 302 may flow through the system of sealed tubes. The second fluid may be at or near a desired set temperature for the sample 302, and energy transfer may occur between the sample 302 and the second fluid through the tubes, which may conduct thermal energy, until the sample 302 has reached the desired set temperature. Notably, although a shell and tube heat exchanger is described herein, the sample-temperature control unit 308 may comprise other types of heat exchangers, including, but not limited to, thermoelectric, electric, and finned tube heat exchanger that are driven by electricity, gas, or liquid; u-tube heat exchangers; and other heat exchangers that would be appreciated by one of ordinary skill in the art in view of this disclosure. Once at or near the set temperature, the sample 302 may be received at a gas extractor 320 of the analyzer 300, the gas extractor 320 being in fluid communication with the sample-temperature control unit 308. Example gas extractors include, but are not limited to, continuously stirred vessels, distillation columns, flash columns, separator columns, or any other vessel that allows for the separation and expansion of gas from liquids and solids. In the embodiment shown, the gas extractor 320 comprises a vessel 322 that receives the sample 302 through a fluid inlet 324 and further comprises a fluid outlet 326 through which a portion of the sample 302 will flow after a gas extraction process. The gas extractor 320 may further comprise an impeller 332 within the vessel 322 to agitate the sample 302 as it enters the vessel 322. The impeller 332 may be driven by a motor 334 that rotates the impeller to create a turbulent flow of the sample 302 within the vessel, which causes gasses trapped within the solids and liquids of the sample 302 to be released into the vessel 322. Although an impeller 332 is shown it is possible to use other agitators that would be appreciated by one of ordinary skill in the art in view of this disclosure.

Gasses within the vessel 322 that are released from the sample 302 through the agitation process may be removed from the vessel through a gas outlet 330. In certain embodiments, the vessel 322 may comprise a gas inlet 328, and at least one carrier gas may be introduced into the vessel 322 through the gas inlet 328. Carrier gasses may comprise atmospheric or purified gasses that are introduced into the vessel 322 to aide in the movement of the extracted gasses to the outlet 330. The carrier gasses may have known chemical compositions such that their presence can be accounted for when the extracted gasses are analyzed.

Although the sample-temperature control unit 308 and gas extractor 320 are shown as separate devices, it may be possible to combine the functionality into a single device. For example, heat exchange may be accomplished through the vessel 322, bringing the sample 302 to a set temperature while it is in the vessel 322. In other embodiments, the sample-temperature control unit 308 may be optional, and the sample 302 may be directed to the extractor 320 without flowing through a sample-temperature control unit 308.

In certain embodiments, the gas outlet 330 of the extractor 320 may be coupled to a pump 336 which may deliver the extracted gas sample from the extractor 320 to a mass spectrometer 338 either constantly or at specified intervals. The pump 336 may comprise a piston pump, positive displacement pump or other type of pump. The mass spectrometer 338 may determine mass-to-charge ratios for the extracted gas sample, which may be communicated to an information handling system 340 that is communicatively coupled to the mass spectrometer. The information handling system 340 may comprise an information handling system dedicated to the analyzer 300, or may comprise the information handling system for a drilling system, as described above. In certain embodiments, the information handling system 340 may be communicatively coupled to other elements of the analyzer 300 (e.g., the pump 306, sample-temperature control unit 308, extractor 320, and pump 346) and may receive data from the elements and/or generate control signals to the elements.

FIG. 4 is a diagram of an example drilling fluid analyzer 400 that analyzes liquids from a drilling fluid sample, according to aspects of the present disclosure. The analyzer 400 may be included with a drilling system at the surface of a formation, and may be in selective fluid communication with a flow of drilling fluid through the drilling system, such as at access points similar to those described above. The analyzer 400 may be included or used in conjunction with an analyzer for extracting and analyzing gas from a drilling fluid sample, such as the analyzer described above with respect to FIG. 3.

In the embodiment shown, the analyzer 400 may receive a drilling fluid sample 402 through a fluid conduit or pipe 404 that is in selective fluid communication with the flow of drilling fluid. As described above, drilling fluid samples may be taken periodically or continuously from the flow of drilling fluid through a drilling system, and the drilling fluid sample 402 may comprise one of those continuous or periodic samples. The drilling fluid sample 402 may be moved within the analyzer 400 using pump 406 in fluid communication with fluid conduit 404 and in selective fluid communication with a sample preparation unit 408, a pyrolysis unit 410, and a mass spectrometer 412 through a network of fluid conduits and valves 450*a-h*.

Once past the pump 406, the sample may be sent to the sample preparation unit 408 by closing valve 450*b*; to the pyrolysis unit 410 by closing valves 450*a*, 450*e*, and 450*g*, and opening valves 450*b*, 450*c*, 450*d* and 450*f*; and directly to the mass spectrometer 412 by closing valves 450*a*, 450*c*, and 450*h*, and opening valves 450*b* and 450*g*. The sample preparation unit 408 may comprise systems and mechanisms that alter the liquid portion of the drilling fluid sample for analysis. The liquid preparations may include, but are not limited to, dilution of the liquid in a solvent, contact between the liquid with an immiscible solvent, aeration by atmospheric or purified gasses, or other liquid preparation techniques that would be appreciated by one of ordinary skill in the art in view of this disclosure. The pyrolysis unit 410 may thermochemically decompose organic material within the drilling fluid sample, which may aide in the analysis of the liquid portion of the drilling fluid sample at the mass spectrometer. Notably, in the embodiment shown, liquid that passes through sample preparation unit 408 may either be sent through the pyrolysis unit 410 before reaching the mass spectrometer by opening valves 450*e* and 450*f* and closing valve 450*d*, or sent directly to the mass spectrometer by closing valves 450*b*, 450*f*, and 450*h* and opening valves 450*e*, 450*d*, 450*c*, and 450*g*.

As described above, the mass spectrometer 412 may determine mass-to-charge ratios for the liquid portion of the drilling fluid sample, which may be communicated to an information handling system 414 that is communicatively coupled to the mass spectrometer 412. The information handling system 414 may be dedicated to the analyzer 400, or may comprise the information handling system for a drilling system, as described above. In certain embodiments, the information handling system 414 may be communicatively coupled to other elements of the analyzer 400 (e.g., the sample preparation unit 408, pyrolysis unit 410, and valves 450*a-h*) and may receive data from the elements and/or generate control signals to the elements to control the fluid pathway for the liquid sample.

The mass spectrometer described any mass spectrometer appreciated by one of ordinary skill in the art in view of this disclosure, including, but not limited to, a Time-of-Flight Mass Spectrometer (TOF-MS) and a Quadrupole Mass Spectrometer (QMS). FIG. 5 is a block diagram illustrating an example mass spectrometer 500, according to aspects of the present disclosure. The mass spectrometer 500 may be in fluid communication with a fluid or gas source 510, which may comprise, for example, one of the systems described above with respect to FIGS. 3 and 4. The mass spectrometer 500 may comprise a TOF-MS 501 and a pump 502. The TOF-MS 301 may comprise an ion creator 505, an ion separator 504, and an ion detector 503. In certain embodiments, the TOF-MS 501 may further comprise a control unit 508 communicably coupled to at least one of the ion creator 505, the ion separator 504, and the ion detector 503. The control unit 508 may comprise an information handling system with at least a processor and a memory device, and may direct commands to and/or receive measurements from at least one of the ion creator 505, the ion separator 504, and the ion detector 503. In certain embodiments, the control unit 508 may comprise or be communicably coupled to an information handling system similar to information handling system unit 160 in FIG. 1. The pump 502 may be coupled to and/or in fluid communication with at least a portion of the TOF-MS 501, and may create a vacuum chamber within the TOF-MS as will be described below. In certain embodiments, the pump 502 may comprise at least one of a roughing pump, a turbomolecular pump, and a molecular diffusion pump. Other ultra-high or high vacuum pumps may be used, as would be appreciated by one of ordinary skill in the art in view of this disclosure.

FIG. 6 is a diagram of an example TOF-MS 600, according aspects of the present disclosure. The TOF-MS 600 may receive molecules 660 from the fluid source 650 at the ion creator 601. The ion creator 601 may then create ions 470 out of the molecules by either adding charge to or removing charge from the molecules. In certain embodiments, the ion creator 601 may create ions out of the molecules using at least one of electron impact ionization, chemical ionization, electrospray ionization, matrix-assisted laser desorption/ionization, inductively coupled plasma, glow discharge, field desorption, fast atom bombardment, thermospray, desorption/ionization on silicon, direct analysis in real time, atmospheric pressure chemical ionization, secondary ion mass spectrometry, spark ionization, and thermal ionization. The above list is not intended to be limiting, and other ionization techniques may be used, as would be appreciated by one of ordinary skill in the art in view of this disclosure.

After the ions 670 are created in the ion creator 601, the ions 670 may be passed into an ion separator 604. The ion separator 604 may separate the ions 670 according to their mass-to-charge ratio. In certain embodiments, the ion separator 604 may comprise, for example, a linear flight tube 605 and a grid plate 606. The grid plate 606 may be coupled to a power source and may generate an electric field. As the ions 670 pass through the grid plate 606/electric field, an equal amount force may be imparted onto each of the ions 670, accelerating the ions 670 into the flight tube 605, toward the ion detector 607. Because the force applied to each ion 670 is the same, the acceleration of each ion 670 and its resulting velocity depends on the mass of the ion. Lighter ions will be accelerated more and travel faster than heavier ions when the same force is applied. Likewise, ions of the same mass will be accelerated at the same rate and travel the same speed. Accordingly, the ions 670 will are effectively separated according to their mass, because the net charge of each ion 670 will be the same.

The accelerated ions 670 will travel within the flight tube 605 until they contact the ion detector 607. The ion detector 607 may generate an output that identifies when the ions 670 contact the ion detector 670. In certain embodiments, the ion detector 607 may generate current or voltage each time an ion 670 contacts the ion detector 607. The output may comprise the resulting electrical signal from the ion detector 670, which includes a series of voltage or current spikes spaced apart in time. The time between the voltage or current spikes in the output signal may correspond to the time between when certain of the ions 670 struck the ion detector 607. The amplitude of the voltage or current spikes may correspond to the number of ions 670 that struck the ion detector 607 at a given time. Example ion detectors include, but are not limited to, secondary emission multipliers, faraday cups, and multichannel plate detectors.

In certain embodiments, the flight tube 605 may comprise a vacuum chamber and a pump 680 may be in fluid communication with the flight tube 605 to generate the vacuum. By removing air from the flight tube 605, the possibility that one of the ions 670 strikes an air molecule is reduced. If the ions 670 strike extraneous molecules while they are traveling within the flight tube 605, they will be deflected, increasing the time it takes from the ions 670 to reach to ion detector 607 (if they do at all) and negatively affecting the accuracy of the output. In certain embodiments, the pump 680 may comprise at least one of a turbomolecular pump and a molecular diffusion pump. The turbomolecular pump and/or the molecular diffusion pump may generate a primary vacuum within the flight tube 605. In certain embodiments, the turbomolecular pump and/or the molecular diffusion pump may be connected in series with a roughing pump that may increase or improve the vacuum within the flight tube 605.

In certain embodiments, the output of the ion detector 607 may comprise the output of the TOF-MS 600. In certain other embodiments, though, the output of the ion detector 607 may be processed before it leaves the TOF-MS 600. For example, an information handling system 608 may be coupled to the ion detector 607 and may convert the output of the ion detector 607 into mass spectra. In certain embodiments, the information handling system 608 may also be coupled to the ion generator 601 and the grid plate 606. The information handling system 608 may receive an indication of the time at which the ions 670 are accelerated and may correlate the time to the time signature of the output of the ion detector 607, and particularly the time at which the various voltage or current spikes occurred. By correlating the time of acceleration with the time when the ions 670 contacted the ion detector 607, the information handling system may determine the mass of the ions 470 that contacted the ion detector 607 at a given time, because the strength of the accelerating force (the electric field) and the distance the ions 670 traveled (the length of the flight tube 605) are known. The resulting output may comprise mass spectra of the ions 670.

FIG. 7 illustrates example mass spectra 700, with the mass-to-charge ratio of the received ions on the x-axis, and the amount of ions of a particular mass-to-charge ratio as a percentage of the ions received on the y-axis. The mass-to-charge ratio on the x-axis may correspond to the masses of various chemicals and compounds by their atomic mass units (AMU). As can be seen, the mass spectra may identify chemicals with AMUs above 140. In certain embodiments, the mass by AMU of the various ions may be extracted from the mass spectra 500, and the type of each ion may be determined by comparing its AMU to the known AMU of any chemical on the periodic table. The mass may be extracted, for example, using one or more deconvolution algorithms that would be appreciated by one of ordinary skill in view of this disclosure. Once the chemical composition of the drilling fluid is known, the fluids and gasses suspended within the drilling fluid may be determined by excluding those chemicals known to have been in the drilling fluid before the drilling fluid was introduced downhole. Additionally, once the types of fluid suspended within the drilling fluid are known, those fluids and gasses and corresponding chemical compositions may be correlated to a data set corresponding to known chemical compositions of subterranean formations, allowing for formation characteristics about the subterranean formation to be determined.

Although the fluid analyzer/TOF-MS has been described herein in the context of a conventional drilling assembly positioned at the surface, the fluid and gas analyzer/TOF-MS may similarly be used with different drilling assemblies (e.g., wirelines, slickline, etc.) in different locations. FIG. 8 is a diagram of an offshore drilling system 800, according to aspects of the present disclosure. As can be seen, portions of the drilling system 800 may be positioned on a floating platform 801. A tubular 802 may extend from the platform 801 to the sea bed 803, where the well head 804 is located. A drill string 805 may be positioned within the tubular 802, and may be rotated to penetrate the formation 806. Drilling fluid may be circulated downhole within the drill string 805 and return to the surface in an annulus between the drill string 805 and the tubular 802. A proximal portion of the tubular 802 may comprise a fluid conduit 807 coupled thereto. The fluid conduit 807 may function as a fluid return, and a drilling fluid analyzer with a mass spectrometer 808, according to aspects of the present disclosure, may be coupled to the fluid conduit 807 and/or in fluid communication with a drilling fluid within the fluid conduit 807. Likewise, the fluid analyzer with mass spectrometer 808 may be communicable coupled to an information handling system 809 positioned on the platform 801.

FIG. 9 is a diagram of a dual gradient offshore drilling system, according to aspects of the present disclosure. As can be seen, portions of the drilling system 900 may be positioned on a floating boat or platform 901. A riser 902 may extend from the platform 901 to the sea bed 903, where the well head 904 is located. A drill string 905 may be positioned within the riser 902 and a borehole 950 within the formation 906. The drill string 905 may pass through a sealed barrier 980 between the riser 902 and the borehole 905. The annulus 992 surrounding the drill string 905 within the riser 902 may be filled with sea water, and a first pump 952 located at the surface may circulate sea water within the riser 902. A second pump 954 positioned at the platform 901 may pump drilling fluid through the drill string 905. Once the drilling fluid exits the drill bit 956 into annulus 958, a third pump 960, located underwater, may pump the drilling fluid to the platform 901. A mass spectrometer may be incorporated at various locations within the system 900, including within pumps 954 and 960, in fluid communication with fluid conduits between pumps 954 and 960, or in fluid communication with fluid conduits between the pumps 954 and 960 and the drill string 905.

According to aspects of the present disclosure, an example method for analyzing drilling fluid used in a drilling operation within a subterranean formation may include receiving a drilling fluid sample from a flow of drilling fluid at a surface of the subterranean formation. A chemical composition of the drilling fluid sample may be determined using a mass spectrometer. A formation characteristic of the subterranean formation may be determined using the determined chemical composition. Determining the chemical composition of the drilling fluid sample may include determining the chemical composition of at least one of extracted gas from the drilling fluid sample and a liquid portion of the drilling fluid sample.

In certain embodiments, the method may include extracting gas from the drilling fluid sample using at least one of a continuously stirred vessel, distillation column, flash column, and separator column. The method further may include altering a temperature of the drilling fluid sample using at least one of a shell and tube heat exchanger, a thermoelectric heat exchanger, an electric heat exchanger, a finned tube heat exchanger, and a u-tube heat exchanger. Extracting gas from the drilling fluid sample may comprise introducing a carrier gas into the extracted gas. In certain embodiments, the method may further comprise altering the liquid portion of the drilling fluid sample. Altering the liquid portion of the drilling fluid sample may comprise at least one of diluting of the liquid portion in a solvent, contacting the liquid portion with an immiscible solvent, aerating the liquid portion with atmospheric or purified gasses, or performing pyrolysis on the liquid portion.

Determining the formation characteristic using the determined chemical composition may comprise comparing the determined chemical composition to known chemical compositions of subterranean formations. The formation characteristics may comprise at least one of a type of rock in the subterranean formation, the presence of hydrocarbons in the subterranean formation, the production potential for a stratum of the subterranean formation, and the movement of fluid within the strata. Receiving the drilling fluid sample from the flow of drilling fluid at the surface of the subterranean formation may comprise receiving the drilling fluid sample from at least one of a return line, a mud tank, a gumbo box, a shale shaker, a suction line, and a stand pipe.

According to aspects of the present disclosure, an example system for analyzing drilling fluid used in a drilling operation within a subterranean formation may include a fluid circulation system positioned at the surface of the subterranean formation and configured to pump a flow of drilling fluid into and receive the flow of drilling fluid from a borehole in the subterranean formation. A drilling fluid analyzer may be in fluid communication with the fluid circulation system to receive and analyze a drilling fluid sample from the flow of drilling fluid. The system may further include an information handling system comprising a processor and a memory device containing a set of instructions that, when executed by the processor, cause the processor to receive an output from the drilling fluid analyzer; determine a chemical composition of the drilling fluid sample; and determine a formation characteristic of the subterranean formation based, at least in part, on the determined chemical composition of the drilling fluid sample.

In certain embodiments, the drilling fluid analyzer may analyze at least one of extracted gas from the drilling fluid sample and a liquid portion of the drilling fluid sample, and the set of instructions that causes the processor to determine the chemical composition of the drilling fluid sample may further cause the processor to determine the chemical composition of at least one of the extracted gas and the liquid portion. The drilling fluid analyzer may comprise at least one of a continuously stirred vessel, distillation column, flash column, and separator column. The drilling fluid analyzer may further comprise at least one of a shell and tube heat exchanger, a thermoelectric heat exchanger, an electric heat exchanger, a finned tube heat exchanger, and a u-tube heat exchanger. In certain embodiments, the drilling fluid analyzer may comprise a sample preparation unit that at least one of dilutes the liquid portion in a solvent, contacts the liquid portion with an immiscible solvent, aerates the liquid portion with atmospheric or purified gasses, and performs pyrolysis on the liquid portion.

In certain embodiments, the set of instructions that causes the processor to determine the formation characteristic based, at least in part, on the determined chemical composition further may cause the processor to compare the determined chemical composition to known chemical compositions of subterranean formations. The formation characteristic may comprise at least one of a type of rock in the subterranean formation, the presence of hydrocarbons in the subterranean formation, the production potential for a stratum of the subterranean formation, and the movement of fluid within the strata. The drilling fluid analyzer may receive the drilling fluid sample at least one of continuously or periodically from the flow of drilling fluid. The fluid circulation system may comprise at least one of a return line, a mud tank, a gumbo box, a shale shaker, a suction line, and a stand pipe. And the drilling fluid analyzer may comprise a mass spectrometer Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method for analyzing drilling fluid used in a drilling operation within a subterranean formation, comprising:

receiving a drilling fluid sample from a flow of drilling fluid at a surface of the subterranean formation;

determining a chemical composition of the drilling fluid sample using a mass spectrometer, wherein determining a chemical composition of the drilling fluid sample further comprises measuring the chemical composition of an extracted gas from the drilling fluid sample and measuring the chemical composition of a liquid portion of the drilling fluid sample;

altering the liquid portion of the drilling fluid sample by performing pyrolysis on the liquid portion; and determining a formation characteristic of the subterranean formation using the determined chemical composition wherein determining the formation characteristic using the determined chemical composition comprises comparing the determined chemical composition to known chemical compositions of subterranean formations.

2. The method of claim 1, further comprising extracting gas from the drilling fluid sample using at least one of a continuously stirred vessel, distillation column, flash column, and separator column.

3. The method of claim 2, further comprising altering a temperature of the drilling fluid sample using at least one of a shell and tube heat exchanger, a thermoelectric heat exchanger, an electric heat exchanger, a finned tube heat exchanger, and a u-tube heat exchanger.

4. The method of claim 2, wherein extracting gas from the drilling fluid sample comprises introducing a carrier gas into the extracted gas.

5. The method of claim 1, wherein the formation characteristic comprises at least one of a type of rock in the subterranean formation, the presence of hydrocarbons in the subterranean formation, the production potential for a strata of the subterranean formation, and the movement of fluid within the strata.

6. The method of claim 1, wherein receiving the drilling fluid sample from the flow of drilling fluid at the surface of the subterranean formation comprises receiving the drilling fluid sample from at least one of a return line, a mud tank, a gumbo box, a shale shaker, a suction line, and a stand pipe.

7. A system for analyzing drilling fluid used in a drilling operation within a subterranean formation, comprising:

a fluid circulation system positioned at the surface of the subterranean formation and configured to pump a flow of drilling fluid into and receive the flow of drilling fluid from a borehole in the subterranean formation;

a drilling fluid analyzer in fluid communication with the fluid circulation system to receive and analyze a drilling fluid sample from the flow of drilling fluid; and an information handling system comprising a processor and a memory device containing a set of instructions that, when executed by the processor, cause the processor to receive an output from the drilling fluid analyzer;

determine a chemical composition of the drilling fluid sample, wherein the drilling fluid analyzer analyzes both an extracted gas from the drilling fluid sample and a liquid portion of the drilling fluid sample; and the set of instructions that causes the processor to determine the chemical composition of the drilling fluid sample further causes the processor to measure the chemical composition of the extracted gas and measure the chemical composition of the liquid portion;

wherein the drilling fluid analyzer comprises a sample preparation unit that performs pyrolysis on the liquid portion; and determine a formation characteristic of the subterranean formation based, at least in part, on the determined chemical composition of the drilling fluid sample, wherein the set of instructions that causes the processor to determine the formation characteristic based, at least in part, on the determined chemical composition further causes the processor to compare the determined chemical composition to known chemical compositions of subterranean formations.

8. The system of claim 7, wherein the drilling fluid analyzer comprises at least one of a continuously stirred vessel, distillation column, flash column, and separator column.

9. The system of claim 8, wherein the drilling fluid analyzer further comprises at least one of a shell and tube heat exchanger, a thermoelectric heat exchanger, an electric heat exchanger, a finned tube heat exchanger, and a u-tube heat exchanger.

10. The system of claim 7, wherein the formation characteristic comprises at least one of a type of rock in the subterranean formation, the presence of hydrocarbons in the subterranean formation, the production potential for a strata of the subterranean formation, and the movement of fluid within the strata.

11. The system of claim 7, wherein the drilling fluid analyzer receives the drilling fluid sample at least one of continuously or periodically from the flow of drilling fluid.

12. The system of claim 7, wherein the fluid circulation system comprises at least one of a return line, a mud tank, a gumbo box, a shale shaker, a suction line, and a stand pipe.

13. The system of claim 7, wherein the drilling fluid analyzer comprises a mass spectrometer.

* * * * *